US007200345B2

(12) United States Patent
Katayanagi et al.

(10) Patent No.: US 7,200,345 B2
(45) Date of Patent: Apr. 3, 2007

(54) IMAGE FORMING APPARATUS WITH A FIXING DEVICE EMPLOYING A PLURALITY OF PRESSING MEMBERS

(75) Inventors: Hidetoshi Katayanagi, Tokyo (JP); Hisayoshi Nagase, Hachioji (JP); Tetsuko Kurosu, Hino (JP); Makoto Fujii, Hino (JP); Naohiko Hanyu, Hino (JP); Miho Toyoda, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 154 days.

(21) Appl. No.: 10/948,566

(22) Filed: Sep. 24, 2004

(65) Prior Publication Data

US 2005/0191071 A1 Sep. 1, 2005

(30) Foreign Application Priority Data

Feb. 26, 2004 (JP) ..... 2004-051440

(51) Int. Cl.
*G03G 15/00* (2006.01)
*G03G 15/20* (2006.01)

(52) U.S. Cl. ..... 399/45; 399/67; 399/329; 399/331

(58) Field of Classification Search ..... 399/45, 399/67, 328, 329, 341, 331; 347/156
See application file for complete search history.

(56) References Cited

U.S. PATENT DOCUMENTS 6,490,429 B2 * 12/2002 Okayasu et al. ..... 399/328
6,983,119 B2 * 1/2006 Nakayama ..... 399/341
2004/0042809 A1 * 3/2004 Fuma et al. ..... 399/67
2005/0074263 A1 * 4/2005 Tanaka ..... 399/333

FOREIGN PATENT DOCUMENTS

| | | | |
|---|---|---|---|
| JP | 54-095246 A | * | 7/1979 |
| JP | 57-045577 A | * | 3/1982 |
| JP | 02-163783 A | * | 6/1990 |
| JP | 04-166878 A | * | 6/1992 |
| JP | 05-165357 A | * | 7/1993 |
| JP | 08-115015 A | * | 5/1996 |
| JP | 09-258596 A | * | 10/1997 |
| JP | 2001-005312 A | * | 1/2001 |
| JP | 2002-268424 A | * | 9/2002 |

* cited by examiner

*Primary Examiner*—Sophia S. Chen
(74) *Attorney, Agent, or Firm*—Finnegan, Henderson, Farabow, Garrett & Dunner, L.L.P.

(57) ABSTRACT

An image forming apparatus is provided with a fixing section, including a heating member, a pressing member, in which the heating member and the pressing member are arranged to form a nipping section therebetween, and a belt member inserted through the nipping section for fixing a toner image on a recordig sheet by conveying the recording sheet through the nipping section; and a control section for controlling the fixing section and obtaining recording sheet information with respect to at least one of a plurality of conditions. The pressig member includes a plurality of pressing heads differing in shape and with respect to at least one of a plurality of characteristics, and the control section selects one of the plurality of pressing heads in accordance with the recording sheet information and controls the fixing section to press the recording sheet through the belt member with the selected one of the plurality of pressing heads.

13 Claims, 6 Drawing Sheets

FIG. 4 ( a )
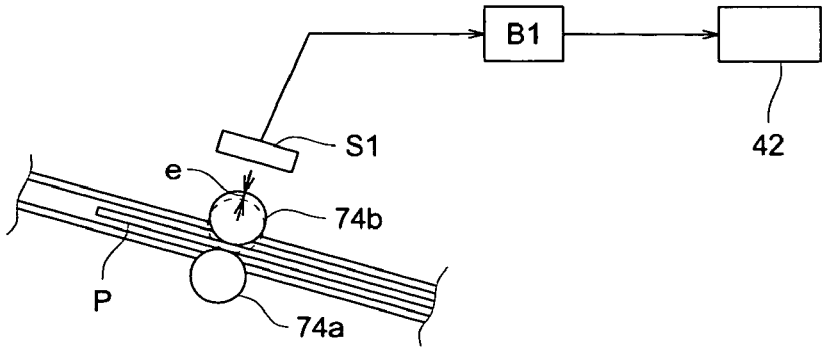
FIG. 4 ( b )
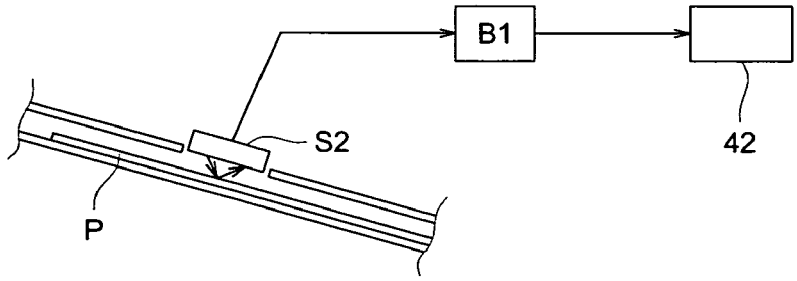
FIG. 4 ( c )
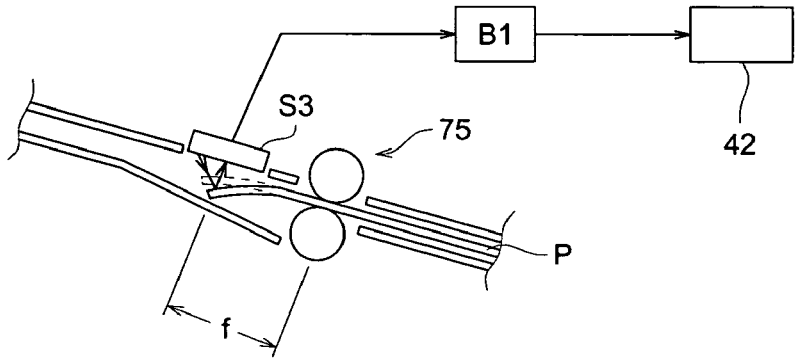
FIG. 4 ( d )
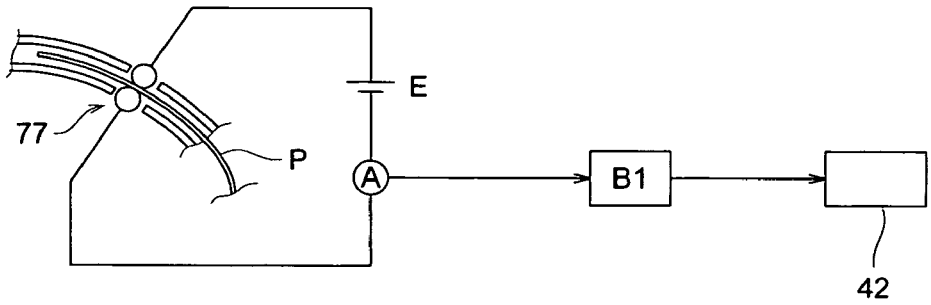

IMAGE FORMING APPARATUS WITH A FIXING DEVICE EMPLOYING A PLURALITY OF PRESSING MEMBERS

BACKGROUND OF THE INVENTION

This invention relates to an electrophotographic image forming apparatus equipped with a fixing device such as a copying machine, printer, facsimile, and so on. Specifically, this invention relates to an electrophotographic image forming apparatus equipped with a fixing device that fixes by clamping, pressing, and heating a paper sheet by two bodies of rotation.

In general, a conventional fixing device fixes a toner image to a transfer sheet by letting a transfer sheet with a toner image pass through a nip area which is formed by two bodies of revolution (rollers) in pressure contact, heating, and pressing the toner image against the transfer sheet.

When the image forming apparatus is of the color type, the transfer sheet is apt to have more toner and consequently it is apt to twine itself around the body of rotation when a toner image is heated and pressed. To prevent this, the nip area is dented in the side of the unfixed toner image. In this case, the roller which is in contact with the backside of the transfer sheet must be harder than the roller which is contact with the toner image side of the transfer sheet. In this case, the nip area is not wide enough for a poor-fixing transfer sheet such as a cardboard. Therefore, to fix such a poor-fixing transfer sheet, we must increase the fixing temperature or reduce the processing speed. As the result, the warm-up time becomes longer and the print productivity becomes lower. Additionally, after passing through the fixing device, such a hard transfer sheet may be curled to the nip shape. As the cardboard is hard and the nip area need not be convex in the side of the roller facing to the backside of the paper, it is possible to decrease the hardness of the roller in the backside of the transfer sheet and to make the nip area flat. However, in this status, a thin paper sheet may twine itself around the roller in the side of the unfixed toner.

To solve the above problems, there have been disclosed various technologies such as a technology (e.g. Patent Document 1) that uses a plurality of rollers to select optimum conditions such as roller temperatures, diameters, circumferential speeds, and surface hardness according to water content and thickness of the transfer sheets and a technology (e.g. Patent Document 2) that select rollers according to the kinds of transfer sheets to suppress wrinkles of an envelope that holds a toner image and to assure the transparency of a color toner image on an OHT sheet (transparent sheet).

Further, another technology (e.g. Patent Document 3) discloses a method of providing a roller to the unfixed toner image side of a transfer sheet, a belt to the opposite side of the transfer sheet, and a plurality of pressing members that press the belt against the roller, selecting one of the pressing members which have different lengths (widths) perpendicular to the movement of the transfer sheet, and causing the selected pressing member to press the belt against the roller with the pressing force changed.

Patent Document 1: Japanese Non-examined Patent Publication S54-95246

Patent Document 2: Japanese Non-examined Patent Publication H04-166878

Patent Document 3: Japanese Non-examined Patent Publication 2001-5312

However, when some rollers are selected, their temperatures must be controlled simultaneously and the power consumption is required too much in the standby status. If this temperature control is omitted to suppress the standby power consumption, it takes much time before the selected rollers reach the preset control temperatures. In other words, it takes a lot of time for the first printout and the fixing may be insufficient. Further, if controlling is made to reduce the circumferential speeds of rollers, the print productivity becomes lower. Therefore, it is not enough to simply provide rollers that are different in temperature, diameter, circumferential speed, and surface hardness and to select them according to the operating conditions because of the long warm-up time after roller selection and the low print productivity. Furthermore, the technology disclosed by Patent Document 3 cannot assure the fixing and paper passing abilities of various kinds of transfer sheets under a changing print environment singly by changing the length (or width) of the pressing member perpendicular to the movement of the transfer sheet.

SUMMARY OF THE INVENTION

An object of this invention is to provide an image forming apparatus having a fixing device that can assure an overall fixing performance such as fixing ability, peeling ability, wrinkle-free properties, and optimization of temperature distribution.

This purpose can be attained by the means below.

An image forming apparatus having a fixing device for fixing a toner image onto a transfer sheet, comprising two bodies of rotation at least one of which is belt-shaped and pressed together to form a nip section, a heat source for heating at least one of the bodies of rotation, and a driving source for rotating at least one of two bodied of rotation to let a transfer sheet pass through the nip section and fix a toner image onto the transfer sheet, wherein the image forming apparatus further comprises a plurality of pressing members for pressing the belt-shaped body of rotation against the other body of rotation, a moving means for moving one of the pressing members towards the nip section and stopping there, a control means for controlling movement and stopping of the pressing member, and at least one of means for setting any of the size, type, brand, thickness, basis weight, smoothness, glossiness, and stiffness of the transfer sheet to be printed on an operation section, means for detecting any of the size, thickness, basis weight, smoothness, glossiness, and stiffness of the transfer sheet before fixing, and means for detecting the environmental temperature or humidity around the image forming apparatus and the temperature or water content of the transfer sheet and one of the pressing members is moved to the nip section before the transfer sheet reaches the nip section.

This invention can provide a fixing device that can assure the overall fixing performance by securing a pressing member that presses a transfer sheet against the roller via the belt and selecting a pressing member according to the condition of the transfer sheet.

BRIEF DESCRIPTION OF THE DRAWINGS

FIGS. 4(*a*) to 4(*d*) each shows an example of a detecting means that detects a condition related to the transfer sheet before transferring.

DETAILED DESCRIPTION OF THE PREFERRED EMBODIMENT

First we explain a fixing device in accordance with this invention and an image forming apparatus which is equipped therewith.

It is to be understood that the description of embodiments below is not intended to limit the technical range of this invention by terms in the description.

Figure 1:
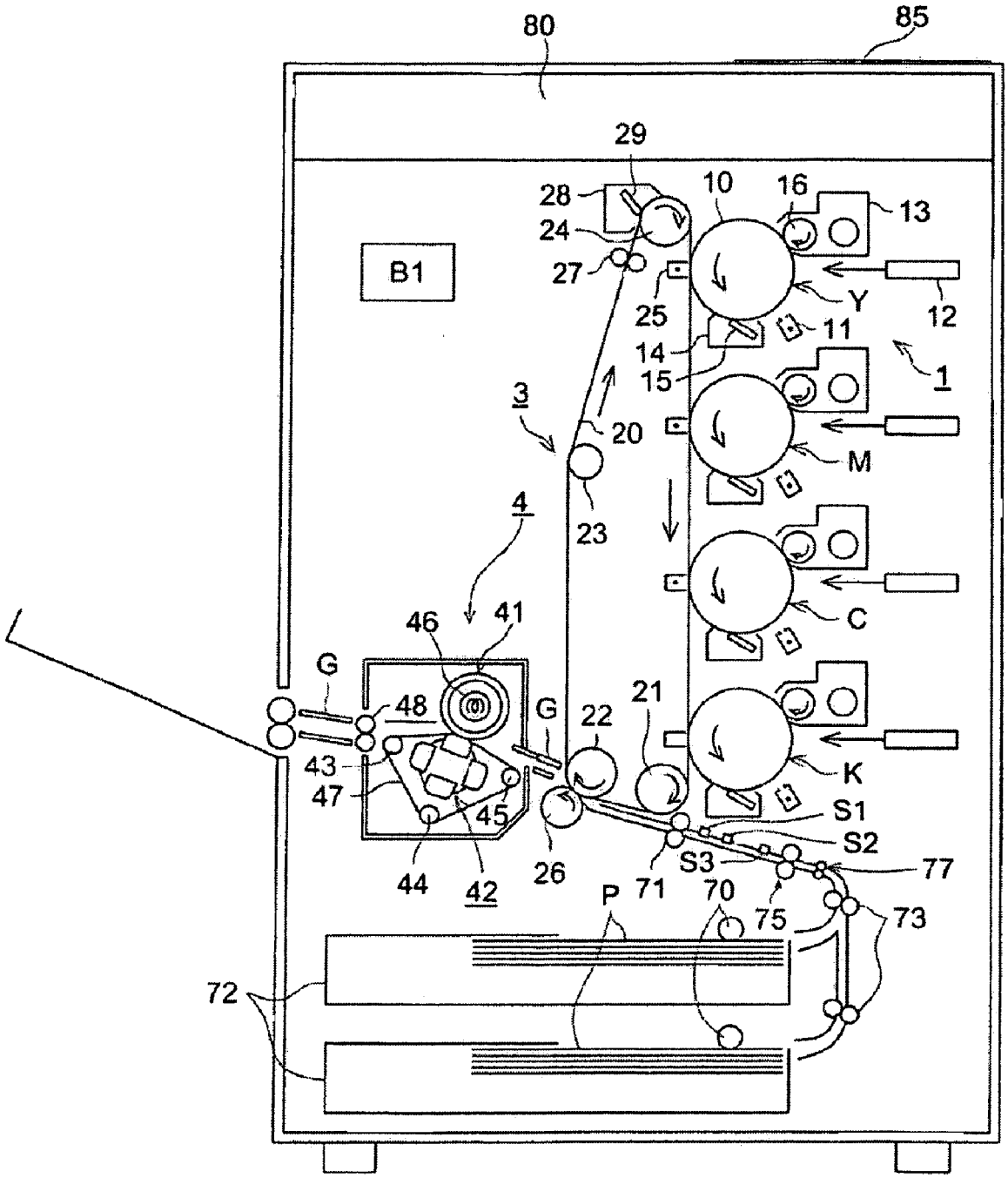
FIG. 1 is a schematic vertical sectional view of the whole image forming apparatus.

FIG. 1 is a schematic vertical sectional view of the whole image forming apparatus.

In FIG. 1, the major components are a photosensitive member 10, a Scorotron charger 11 as a charging means, an image writer 12 as an image writing means, a developer 13 as a developing means, a cleaning device 14 for cleaning the surface of the photosensitive member 10, a cleaning blade 15, a developing sleeve 16 and an intermediate transfer belt 20. The image forming apparatus 1 consists of the photosensitive member 10, the Scorotron charger 11, the developer 13, the cleaning device 14, and so on. The image forming means 1 of four colors (yellow Y, magenta M, cyan C, and black K) are the same in mechanical configuration. So, in FIG. 1, the reference characters are assigned only for the configuration of the yellow image forming means as the representative.

The image forming means 1 of four colors (yellow Y, magenta M, cyan C, and black K) are provided in that order of Y, M, C, and K along the movement of the intermediate transfer belt 20. The photosensitive members 10 are respectively in contact with the tensioned surface of the intermediate transfer belt 20 and rotate there in the same direction as the movement of the intermediate transfer belt 20 at the same line speed.

The intermediate transfer belt 20 are supported and tensioned by a driving roller 21, a grounding roller 22, a tension roller 23, a neutralization roller 27, and a driven roller 24. A belt unit 3 consists of these rollers, the intermediate transfer belt 20, a transfer device 25, and a cleaning device 28.

The intermediate transfer belt 20 is driven by the rotation of a driving roller 21 by a driving motor (which is not shown in the figure).

The photosensitive member 10 is made of a cylindrical metallic base such as an aluminum cylinder which has a photoconductive layer such as an electroconductive layer, a-Si layer or an organic photosensitive layer (OPC) on its circumferential surface and rotates counterclockwise (in the arrow direction of FIG. 1) with the conductive layer. grounded.

An electric signal corresponding to the image data sent from an image reader 80 is converted into an optical signal by an image formation laser and the optical signal is projected to the photosensitive member 10 by the image writer 12.

The developer 13 is equipped with a cylindrical non-magnetic stainless-steel or aluminum developing sleeve 16 which is at a preset space away from the circumference of the photosensitive member 10 and rotates in the same direction as the photosensitive member 10 at the most closest position.

The intermediate transfer belt 20 is an endless belt of a volume resistivity of $10^6$ to $10^{12}$ Ω·cm. It is a semi-conductive seamless belt of 0.015 to 0.05 mm thick prepared by dispersing a conductive material in engineering plastic such as modified polyimide, thermosetting polyimide, ethylene-tetrafluoro-ethylene copolymer, vinylidene polyfluoride, and nylon alloy.

The transfer device 25 has a function of transferring a toner image from the photosensitive member 10 onto the intermediate transfer belt 20 when receiving a d.c. current of a polarity opposite that of the toner. The transfer device 25 can be a corona discharger or a transfer roller.

The transfer roller 26 can move to touch or detach from the grounding roller 22 and transfer the toner image from the intermediate transfer belt 20 to a transfer sheet P.

The cleaning device 28 is provided opposite the driven roller 24 with the intermediate transfer belt 20 therebetween. After the intermediate transfer belt 20 transfers the toner image onto the transfer sheet P, the charge of toner left on the transfer belt 20 is weakened by the neutralization roller 27 which has an a.c. voltage superimposed with a d.c. voltage whose polarity is opposite the polarity of the toner. Then the toner on the surface of the transfer belt 20 is scraped away by the cleaning blade 29. The fixing device 4 in accordance with this invention will be explained in detail below.

The other components are paper pickup rollers 70, timing rollers 71, paper cassettes 72, paper feed rollers 73, an operation panel 85, and a controller B1 as a control means.

Below will be explained the fixing device 4 in accordance with this invention.

Figure 2:
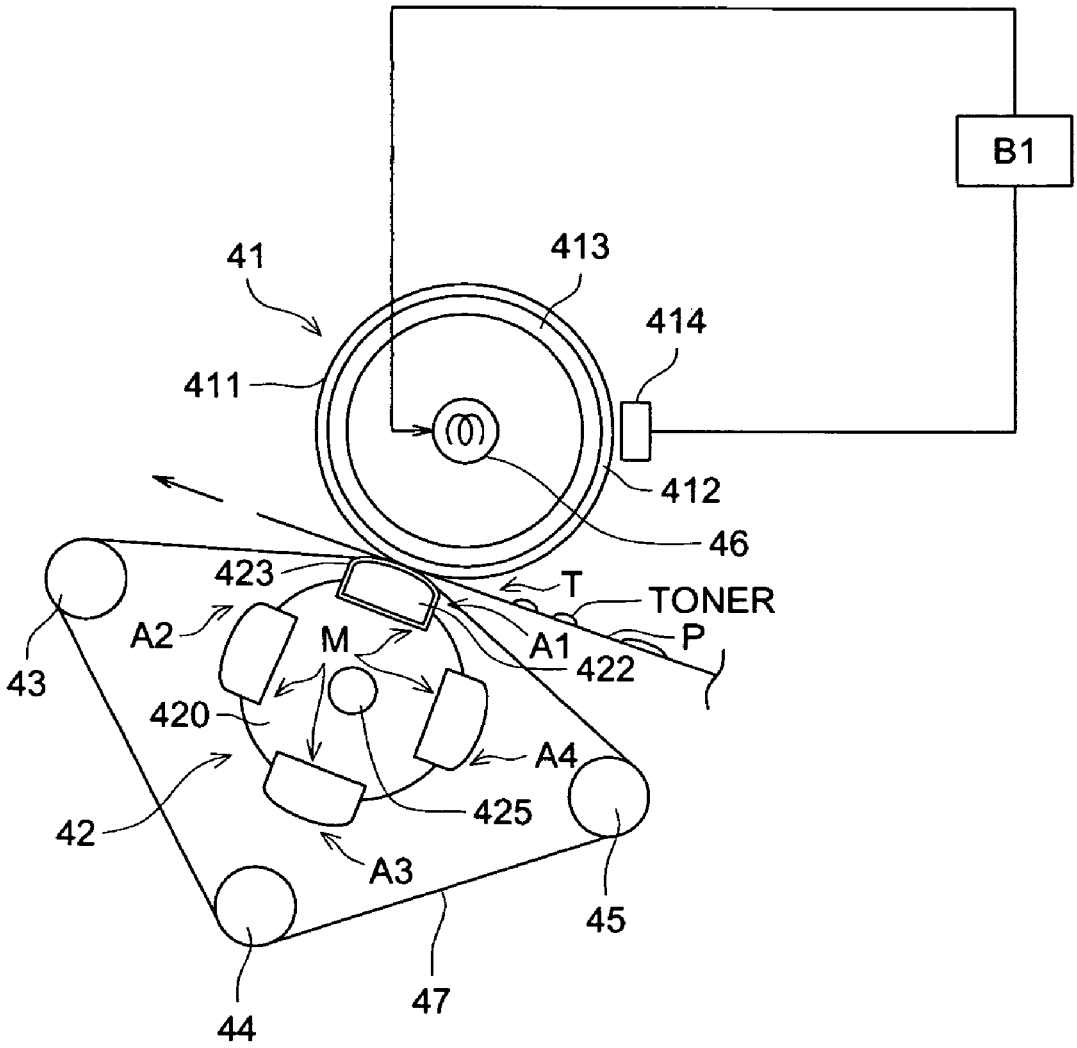
FIG. 2 is an explanatory sectional view of the pressing member moving means.

FIG. 2 is an explanatory sectional view of the pressing member moving means.

In FIG. 2, the heating roller 41 is a cylindrical aluminum mandrel 413 coated with an elastic heat resisting layer 412 and an outer separation layer 411. The heating roller 41 is heated to a preset temperature by a halogen heater 46 as a heating source in the hollow part of the heating roller 41. The temperature is detected by a non-contact temperature sensor 414 provided near the surface of the heating roller 41 and sent to the controller B1. The controller B1 controls the surface temperature of the heating roller 41 to a preset temperature by turning on and off the halogen heater 46.

The pressing belt 47 is a polyimide belt coated with a silicone rubber layer and a thin PFA resin layer. When a transfer sheet P having a toner image comes into the nip section which is a fixing area by means of the paper guides and the like, the pressing belt 47 and the pressing pad (pressing head) A1 catch and press the transfer sheet P against the heating roller 41 to fix the toner image onto the transfer sheet P.

The pad moving mechanism 42 consists of a cylindrical pad supporting roller 420, and pressing pads (A1, A2, A3, and A4). The rigid pad supporting roller 420 made of a rigid material has a plurality of longitudinal grooves M to hold the pressing pads (pressing heads) (A1, A2, A3, and A4).

At least one of the pressing pads (A1, A2, A3, and A4) is different from the other pressing pads in hardness, heat capacitance, thickness or heat capacitance distribution along and perpendicular to the movement of the pressing belt.

The heat conductivity of the pad supporting roller 420 is preferably low. The pad supporting roller 420 is mounted on a rotary shaft 425 which is driven by a driving section (which is not shown in the figure).

By an instruction of the controller B1, the rotary shaft 425 is rotated a preset angle to move any of the pressing pads (A1 to A4) to the heating roller 41, stopped and held at a preset position to press the heating roller 41 and form a nip section T.

Therefore, the nip sections T formed by respective pressing pads (A1 to A4) are different in pressure, nip length, and fixing condition.

Although this embodiment uses four pressing pads (A1 to A4), four or more pressing pads can be used.

Referring to FIG. 1, still other components are guide plates G, a belt driving roller 43, a tension roller 44, a driven roller 45, a halogen heater 46, and ejection rollers 48.

Figure 3:
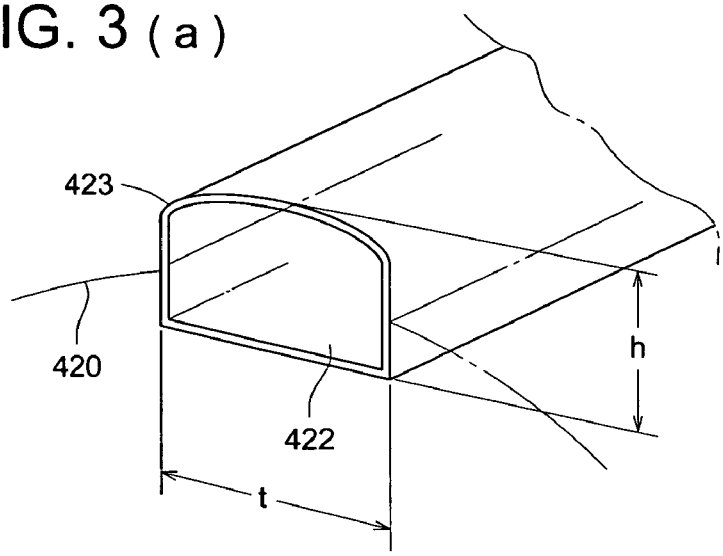
FIGS. 3(*a*) to 3(*d*) each shows details of the pressing pad.
Figure 3:
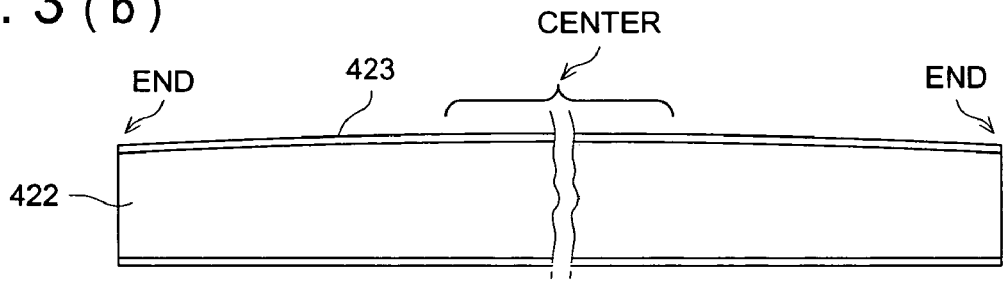
Figure 3:
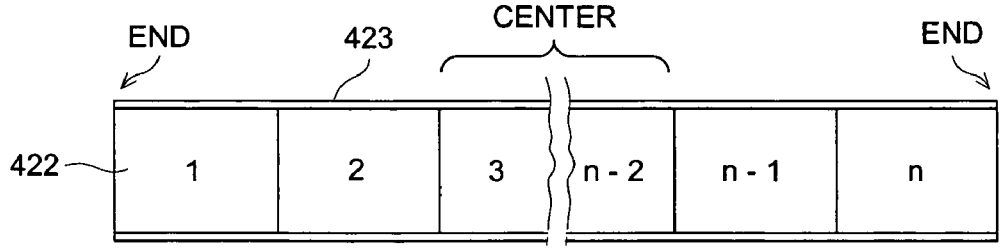
Figure 3:
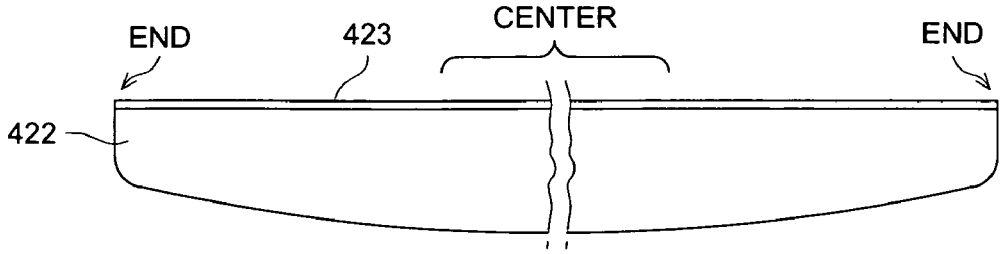

FIG. 3 shows details of the pressing pad.

In FIG. 3(*a*), the pressing pad (A1 to A4) is an elastic silicone rubber member 422 coated with Teflon®-related sliding sheet 423.

At least one of the pressing pads (A1 to A4) is different from the other pressing pads in hardness, heat capacitance, thickness "t" along the movement of the transfer sheet, thickness "h" perpendicular to the movement of the transfer sheet, distribution of thickness "h" perpendicular to the movement of the transfer sheet, distribution of heat capacitance perpendicular to the movement of the transfer sheet, and distribution of hardness perpendicular to the movement of the transfer sheet.

The base of the elastic member 422 is low heat conduction silicone rubber of a heat conductivity of 0.05 to 0.25 W/m·k and coated with a sliding sheet 423 made from Teflon®-related plastic resin (PTFE, etc.) to reduce the friction between the pressing belt 47 and the elastic member.

As shown in FIG. 3(*b*), it is possible to make the pressing pads (A1 to A4) thicker in the center "h" (than the ends). Further as shown in FIG. 3(*c*), it is possible to divide the pressing pad in one groove into a plurality of pieces (1 to n), make the pieces 422 higher in hardness towards the center of the groove (or lower towards the outer ends of the pad). Furthermore as shown in FIG. 3(*c*), it is possible to divide the pressing pad in one groove into a plurality of pieces (1 to n), make the pieces 422 lower in heat conductivity towards the center of the groove (or higher towards the outer ends of the pad). Still further, as shown in FIG. 3(*d*), it is possible to curve the groove M and make the pressing pad thicker in the center "h" (or lower in the ends).

The pressing pads (A1 to A4) of these different configurations are respectively bonded to the grooves, selected and moved under a selected condition (size, type, brand, thickness, basis weight, smoothness, glossiness, and stiffness of the transfer sheet to be printed) when the condition is preset on the operation section.

When a condition (size, thickness, basis weight, smoothness, and glossiness of the transfer sheet) is detected before image transferring and the result of detection is sent to the control section B1 in advance, a pressing pad satisfying the condition is selected.

Further, when an environmental temperature or humidity of the image forming apparatus and the temperature or water content of the transfer sheet is detected and the result of detection is sent to the control section B1 in advance, a pressing pad satisfying the condition is selected.

The optimum fixing is enabled by the nip section T formed by the selected pressing pad (A1 to A4) and the heating roller 41.

A program created by experimental data is used to select a pressing pad that satisfies a condition (size, quality, brand, thickness, basis weight, smoothness, glossiness, stiffness, environmental temperature or humidity, and temperature or water content of the transfer sheet). The program is stored in the control section B1.

FIG. 4 shows an example of a detecting means that detects a condition related to the transfer sheet before transferring.

FIG. 4(*a*) is a detecting means that measures the thickness of the transfer sheet P. In FIG. 4(*a*), the ends of the roller 74*a* are supported by bearings provided on the frame which is not shown in the figure. The roller 74*b* is a displacement roller which is supported by bearings to move perpendicularly to the movement of the transfer sheet. The sensor S1 is a displacement detection sensor such as an ultrasonic sensor S1.

When the transfer sheet P is clamped and carried by the rollers (74*a* and 74*b*), the roller 74*b* moves from the dotted-line position to the solid-line position by the thickness "e" of the transfer sheet P. The displacement sensor S1 detects this displacement and sends the displacement information to the control section B1. The control section B1 selects a pressing pad fit for the thickness.

FIG. 4(*b*) shows a detector that measures the smoothness and the glossiness of the transfer sheet P. In FIG. 4(*b*), the sensor S2 detects the quantity of light reflected on the transfer sheet P to measure the roughness and glossiness of the surface of the transfer sheet, and sends its information to the control section B1. The control section B1 selects a pressing pad fit for the roughness and glossiness.

FIG. 4(*c*) shows a detector that measures the stiffness of the transfer sheet P. In FIG. 4(*c*), a pair of rollers 75 in the delivery path transfer the transfer sheet P. The sensor S3 for detecting the quantity of light reflected on the transfer sheet is provided a preset distance "f" from the delivery roller pair 75.

The transfer sheet P is clamped and carried by the delivery roller pair 75 and its leading edge is detected.

The sheet P warps much if the stiffness of the transfer sheet P is low or small if the stiffness of the transfer sheet P is high. The quantity of light that the sensor S3 receives is dependent upon the magnitude of this warp. The sensor S3 detects the stiffness of the transfer sheet from the relationship between the light quantity and the warp magnitude and sends the result of detection to the control section B1. The control section B1 selects a pressing pad fit for the stiffness.

FIG. 4(*d*) shows a detector for measuring the water content of the transfer sheet. In FIG. 4(*d*), the roller pair 77 is a pair of conductive delivery rollers to clamp and carry the transfer sheet. As a voltage E is applied to this roller pair 77, the resistance between the rollers (equivalent to the paper resistance) becomes low and the current A becomes greater when the water content of the transfer sheet is high. Contrarily, when the water content of the transfer sheet is low, the resistance becomes high and the current A becomes lower. The information of this current A is sent to the control section B1, and the control section B1 selects a pressing pad fit for the water content.

Additionally, a sensor for detecting the environmental temperature or humidity of the image forming apparatus is provided inside near the casing of the image forming apparatus and a sensor for detecting the temperature of the transfer sheet is provided in the paper feed section. Their information is sent to the control section B1 and used to select an optimum pressing pad. The casing of the image forming apparatus has apertures (narrow enough to prevent invasion of fingers) near the sensor for detecting the environmental temperature or humidity of the image forming apparatus.

The transfer sheet sizes can be automatically detected by a well-known means in a paper cassette 72.

Figure 5:
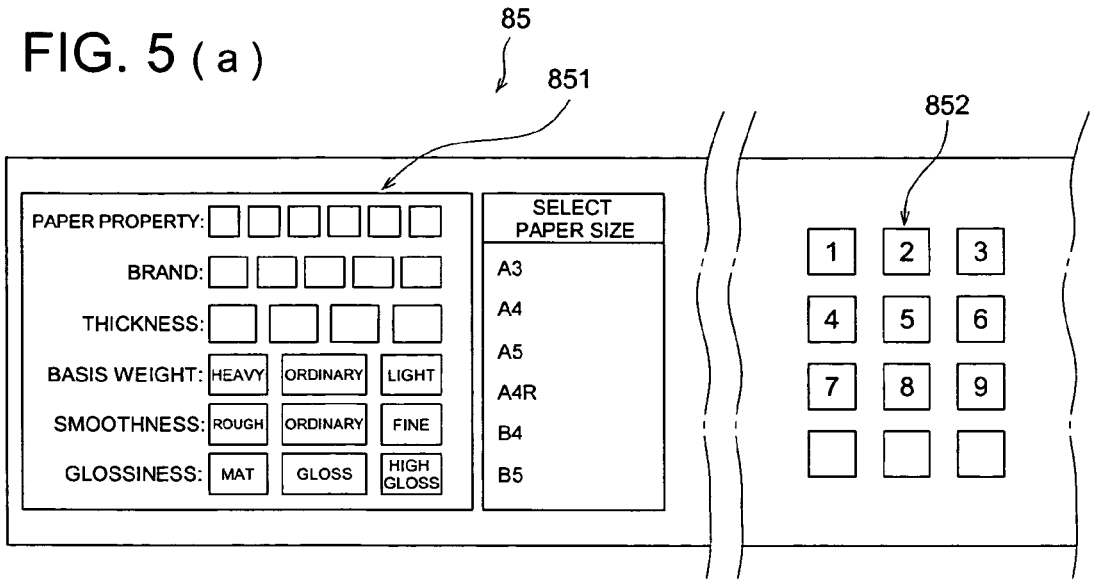
FIGS. 5(*a*) and 5(*b*) each shows part of an operation panel provided on the top of the image forming apparatus.
Figure 5:
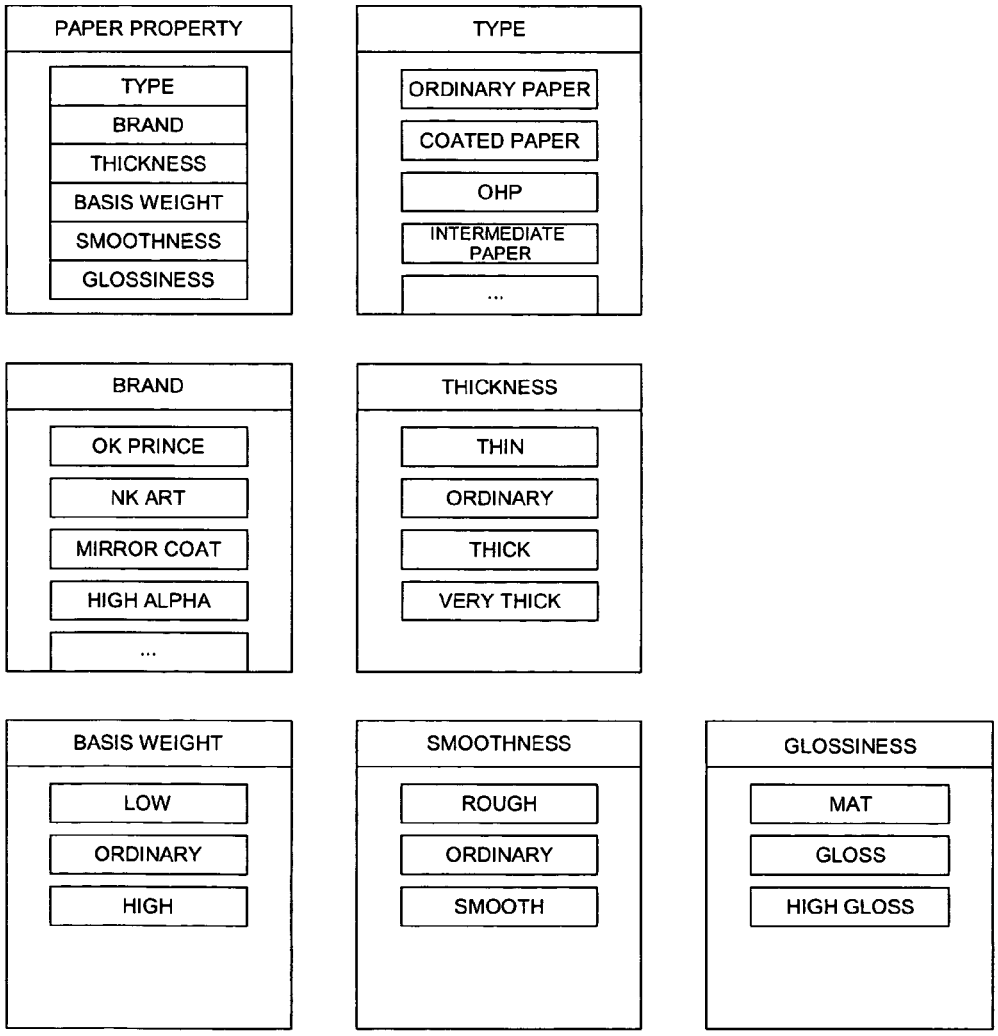

FIG. 5 shows part of an operation panel provided on the top of the image forming apparatus.

The operation panel has a paper property selection field.

FIG. 5(*a*) shows a list of paper property items to be selected.

FIG. 5(*b*) shows an example of paper property items.

As already explained, paper properties can be detected and selected by sensors provided in the paper feed and delivery paths. Further there has been a method of enabling the operator to enter paper properties and controlling selection of an optimum pressing pad. This method will be explained in detail below.

In FIG. 5, the operation panel 85 has a paper property selection field 851 which is a means to set paper properties.

When the operator sets any paper properties (size, type, brand, thickness, basis weight, smoothness, and glossiness of the transfer sheet) on the paper property selection field 851, the control section B1 selects a pressing pad that satisfies the preset condition.

Figure 6:
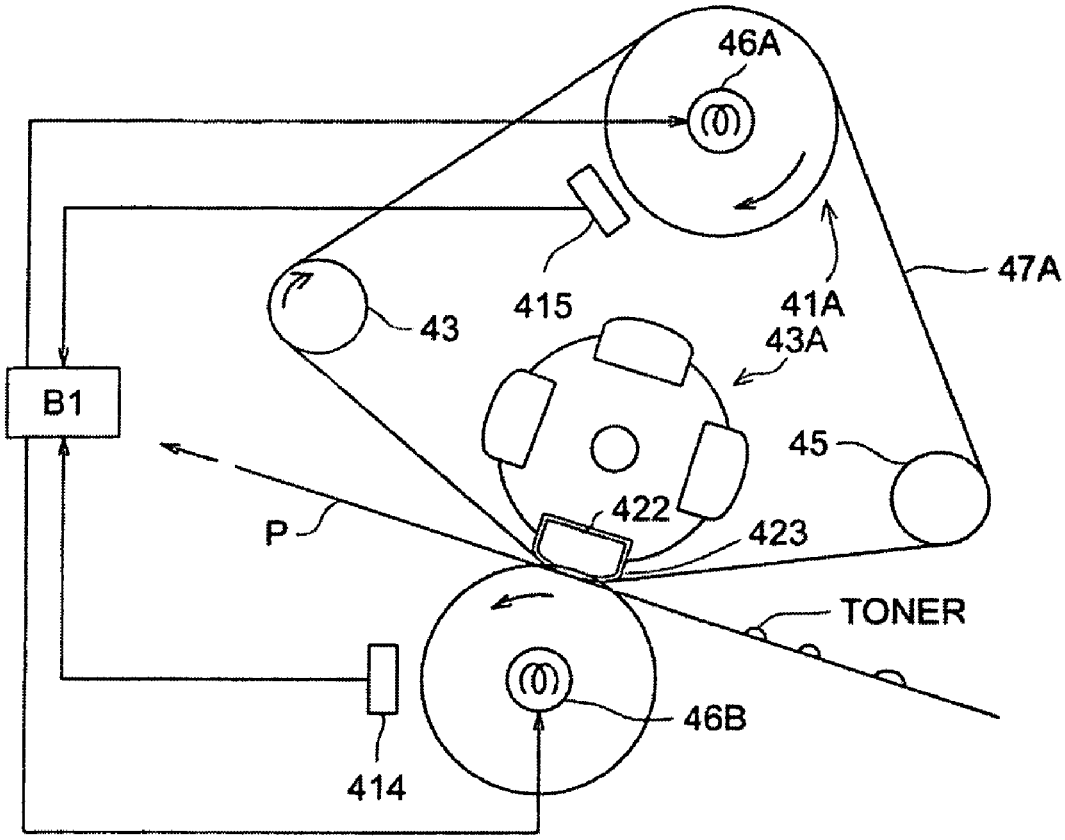
FIG. 6 shows a mechanism that places the pressing means inside the heating belt and pressing the belt against the pressing roller.

Although the above embodiment uses a roller as a body of rotation that is in contact with unfixed toner and a belt as another body of rotation that is in contact with the backside of the transfer sheet, the configuration of FIG. 6 can attain the effect of this invention.

FIG. 6 shows a mechanism that places the pressing means inside the heating belt and pressing the belt against the pressing roller.

The fixing method of FIG. 6 uses a heating roller 41A, a belt driving roller 43, a driven roller 45, heats the heating belt 47A, presses the transfer sheet P with a toner image against the heating roller by the pressing means 43A and heats the transfer sheet. Two halogen heaters (46A and 46B) are controlled individually to turn on and off by the control section B1 according to the outputs of the temperature sensors (415 and 414). The belt heating roller 41A is made of a cylindrical aluminum mandrel coated with fluorine resin or the like. Its configuration is basically the same as that of FIG. 2 and its explanation is omitted.

A program that enables the operator to enter property values (thickness, basis weight, smoothness, glossiness, and so on) is stored in the control section B1. By entering values using the ten-key pad 852 (see FIG. 5), the operator can select a pressing pad fit for the preset condition.

What is claimed is:

1. An image forming apparatus, comprising:

an image forming section for forming a toner image on a recording sheet;

a fixing section including a heating member which comes in contact with the toner image, a pressing member including a plurality of pressing heads, the pressing member and the heating member being arranged to form a nipping section therebetween, and a belt member inserted through the nipping section for fixing the toner image on the recording sheet by conveying the recording sheet through the nipping section; and a control section for controlling the fixing section and obtaining recording sheet information with respect to at least one of a plurality of conditions, the control section selecting one of the plurality of pressing heads based on the recording sheet information;

wherein each of the plurality of pressing heads includes an elastic member and differs in shape and with respect to at least one of a thickness distribution along the direction perpendicular to the conveying direction, a heat capacitance distribution along the direction perpendicular to the conveying direction, and a hardness distribution along the direction perpendicular to the conveying direction, and wherein the control section controls the fixing section to press the recording sheet through the belt member with the selected one of the plurality of pressing heads.

2. The image forming apparatus of claim 1, wherein the plurality of conditions include size, type, brand, thickness, weight, smoothness, glossiness, stiffness, temperature, and water content of the recording sheet.

3. The image forming apparatus of claim 1, wherein the control section includes an operating section for setting at least one of the plurality of conditions including size, type, brand, thickness, weight, smoothness, glossiness, and stiffness of the recording sheet.

4. The image forming apparatus of claim 1, wherein the control section includes a detecting section for detecting at least one of an environmental temperature around the image forming apparatus, a humidity around the image forming apparatus, a temperature of the recording sheet, a water content of the recording sheet, a size of the recording sheet, a thickness of the recording sheet, a weight of the recording sheet, a smoothness of the recording sheet, a glossiness of the recording sheet, and a stiffness of the recording sheet.

5. The image forming apparatus of claim 1, wherein the elastic member has a heat conductivity of 0.05 to 0.25 W/mk.

6. The image forming apparatus of claim 1, wherein the pressing member further includes a cylindrical member around which the plurality of pressing heads are mounted, a shifting member for rotating the cylindrical member to shift the selected one of the plurality of pressing heads to the nipping section, and a holding section for holding the cylindrical member at the shifted position.

7. The image forming apparatus of claim 1, wherein the heating member is a heating roller and the selected one of the plurality of pressing heads forms the nipping section with the heating roller through the belt member, and wherein the nipping section is structured such that the recording sheet is conveyed through between the heating roller and the belt member.

8. The image forming apparatus of claim 1, wherein the belt member is a heating belt member, which functions as the heating member, and the pressing member includes a pressing roller located opposite to the selected one of the plurality of pressing heads for forming the nipping section through the heating belt member, and wherein the nipping section is structured such that the recording sheet is conveyed through between the heating belt member and the pressing roller.

9. An image forming apparatus, comprising:

an image forming section for forming a toner image on a recording sheet;

a fixing section including a heating member which comes in contact with the toner image, a pressing member including a plurality of pressing heads, the pressing member and the heating member being arranged to form a nipping section therebetween, and a belt member inserted through the nipping section for fixing the toner image on the recording sheet by conveying the recording sheet through the nipping section; and a control section for controlling the fixing section and obtaining recording sheet information with respect to at least one of a plurality of conditions, the control section selecting one of the plurality of pressing heads based on the recording sheet information, wherein each of the plurality of pressing heads differs in shape and with respect to at least one of a plurality of characteristics, wherein each of the plurality of pressing heads includes an elastic member, the elastic member having a heat conductivity of 0.05 to 0.25 W/mk, and wherein the control section controls the fixing section to press the recording sheet through the belt member with the selected one of the plurality of pressing heads.

10. The image forming apparatus of claim 9, wherein the plurality of characteristics include hardness, heat capacitance, a thickness along a conveying direction of the recording sheet, a width along a direction perpendicular to the conveying direction, a thickness distribution along the direction perpendicular to the conveying direction, a heat capacitance distribution along the direction perpendicular to the conveying direction, and a hardness distribution along the direction perpendicular to the conveying direction.

11. The image forming apparatus of claim 9, wherein the pressing member further includes a cylindrical member around which the plurality of pressing heads are mounted, a shifting member for rotating the cylindrical member to shift the selected one of the plurality of pressing heads to the nipping section, and a holding section for holding the cylindrical member at the shifted position.

12. The image forming apparatus of claim 9, wherein the heating member is a heating roller and the selected one of the plurality of pressing heads forms the nipping section with the heating roller through the belt member, and wherein the nipping section is structured such that the recording sheet is conveyed through between the heating roller and the belt member.

13. The image forming apparatus of claim 9, wherein the belt member is a heating belt member, which functions as the heating member, and the pressing member includes a pressing roller located opposite to the selected one of the plurality of pressing heads for forming the nipping section through the heating belt member, and wherein the nipping section is structured such that the recording sheet is conveyed through between the heating belt member and the pressing roller.

* * * * *